US005163198A

United States Patent [19]

Herber

[11] Patent Number: 5,163,198

[45] Date of Patent: Nov. 17, 1992

[54] PROCESS FOR MANUFACTURING A PLASTIC SHOE

[75] Inventor: Karlheinz Herber, Sinntal Mottgers, Fed. Rep. of Germany

[73] Assignee: Alsa GmbH, Steinau-Uerzell, Fed. Rep. of Germany

[21] Appl. No.: 614,120

[22] Filed: Nov. 16, 1990

[30] Foreign Application Priority Data

Nov. 18, 1989 [DE] Fed. Rep. of Germany ..... 3938403

[51] Int. Cl.[5] ..... A43C 13/14

[52] U.S. Cl. ..... 12/146 D; 36/77 M; 36/72 R

[58] Field of Search ..... 36/77 R, 77 M, 72; 12/142 E, 142 EV, 146 D, 146 C

[56] References Cited

U.S. PATENT DOCUMENTS

| | | | |
|---|---|---|---|
| 2,740,209 | 4/1956 | Shultz | 36/77 R |
| 2,756,519 | 7/1956 | Hill | 36/77 R |
| 3,165,841 | 1/1965 | Rollman | 36/77 R |
| 3,593,438 | 7/1971 | Mitchell | 36/77 R |
| 4,011,667 | 3/1977 | Greenan | 36/77 R |
| 4,257,177 | 3/1981 | Unsted | 36/77 R |
| 4,342,159 | 8/1982 | Edwards | 36/77 R |
| 4,412,393 | 11/1983 | Terlizzi, Jr. et al. | 12/142 P X |
| 4,566,197 | 1/1986 | Sitzes | 36/77 R X |
| 4,778,145 | 10/1988 | Savori et al. | 36/77 R X |
| 4,811,501 | 3/1989 | Okayasu | 36/94 |

FOREIGN PATENT DOCUMENTS

| | | |
|---|---|---|
| 1685262 | 3/1971 | Fed. Rep. of Germany . |
| 1685392 | 11/1971 | Fed. Rep. of Germany . |
| 3014728 | 10/1980 | Fed. Rep. of Germany . |
| 2935959 | 4/1981 | Fed. Rep. of Germany . |
| 3626710 | 10/1987 | Fed. Rep. of Germany . |

*Primary Examiner*—Paul T. Sewell
*Assistant Examiner*—Ted Kavanaugh
*Attorney, Agent, or Firm*—Wegner, Cantor, Mueller & Player

[57] ABSTRACT

A plastic shoe has a steel cap (3) which has a cushion (4) in the upper region inside the shoe. In its other regions the steel cap (3) is surrounded on the inside and outside by plastic foam which forms the upper (1) and the bottom (2) of the plastic shoe (2). The cushion (4) consists of an air-absorbing material, so that the air displaced under the cap during the foam-filling of the mold does not lead to voids in the plastic.

9 Claims, 1 Drawing Sheet

PROCESS FOR MANUFACTURING A PLASTIC SHOE

DESCRIPTION

Figure 1:
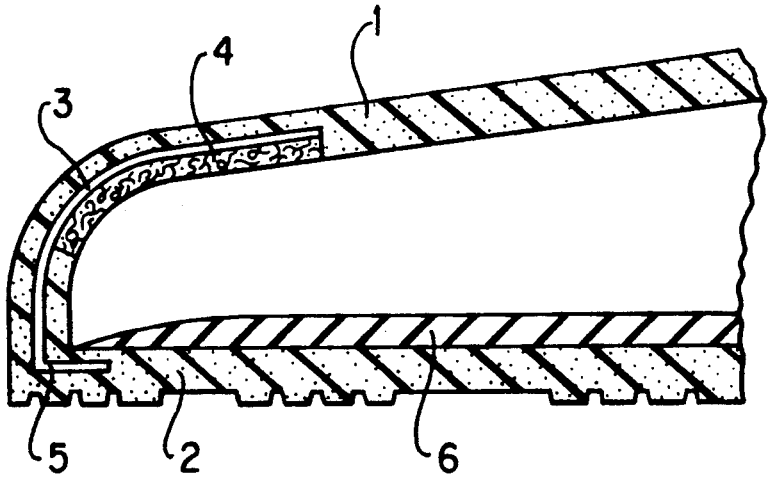

The invention relates to a plastic shoe made of a plastic expanding in a mold, preferably polyurethane, which has a steel cap in its toe region. The invention relates further to a process for manufacturing such a plastic shoe wherein the plastic is introduced into an open female mold, then a last is inserted as mold core, and then a male mold is placed on the female mold.

Shoes made of polyurethane are worn, for example, in the wet area of butcher stores because, in contrast to leather shoes, they are very easy to clean and disinfect. A plastic shoe of the prior art marketed in large numbers is known under the name "Jollys." That shoe is worn for leisure activities, especially for gardening work, but also in operating rooms of hospitals and in industry.

For numerous instances of use it is required that the shoe have a steel cap. For shoes having a steel cap, the latter is usually glued into the shoe. Such a manufacturing process would be undesirably expensive for a plastic shoe, since the gluing-in of steel caps would require an additional, time-consuming work step in each instance. Bringing the steel cap into the mold leads to problems because, during the foam-filling of the mold, air collects in the upper region of the steel cap and therefore no plastic arrives there, so that the steel cap remains uncushioned in that region. Of course, this defect could be counteracted by providing the steel cap with a cushion on its entire inside. However, that would have the disadvantage that it would only be surrounded on one side by the plastic of the shoe and hence would be less firmly anchored in the plastic. In the event of an impact from the front, the cap might then slip backward in the shoe.

In the case of leather and PVC boots it is also already known to inject a steel cap on the outside. In the manufacture of such boots, however, the plastic is injected into a closed mold (injection molding), so that the aforesaid problems caused by air inclusions do not occur.

The underlying problem addressed by the invention is to form a plastic shoe of the above-cited type such that its steel cap is completely surrounded with cushioning material on its inside and is anchored as firmly as possible in the shoe toe. In addition, a process for manufacturing such a shoe is to be developed.

The first-cited problem is solved according to the invention in that the steel cap has an air-absorbing cushion in its upper region and is set into the plastic of the shoe in its other regions.

Owing to this construction according to the invention, the steel cap of the plastic shoe is reliably anchored in the plastic of the shoe in its lower region due to the complete enclosure in plastic. In the adjoining upper region it has the cushion on the inside, so that the foot can never come directly against the steel cap. During manufacture of the shoe, the cushion absorbs air displaced from the expanding plastic in the cap region and diverts it upward to some extent. Hence, air bubbles cannot prevent the foaming around the steel cap on the inside with plastic foam and its resultant reliable anchoring. Accordingly, the function of the cushion is not only to cushion the steel cap on the inside in the finished shoe, but also to prevent air-bubble inclusions in the plastic during manufacture.

Without the cushion according to the invention, during the foam-filling there would be a danger that air would be forced out from the critical region under the steel cap toward the end of the foam-filling process and then would be captured in the plastic foam that had already reacted in the upper region of the shoe so that voids would form there.

The second-cited problem, namely the creation of a process for manufacturing the plastic shoe, is solved according to the invention in that a steel cap which has an air-absorbing cushion exclusively in its upper region is mounted on the toe of a last at a small distance from the last's surface.

By means of this process it is ensured that no air bubbles can collect in the upper cap region during the foam-filling, whereby uncushioned cap regions would result. It is thereby further achieved that the steel cap is reliably anchored in the plastic in the lower region.

During manufacture of the shoe, the steel cap need only be placed manually onto a last if magnets are fastened to the last as spacers for the steel cap. These magnets enable the steel cap to be held sufficiently firmly in the mold during the foam-filling, so that they do not slip.

The steel cap is embedded especially firmly in the plastic of the shoe if a steel cap is used which projects into the sole of the plastic shoe with a flanged region.

The required spacers also do not lead to places at which there is no plastic foam or cushion material, if the spacers are disposed exclusively in the region of the cushion and of the flanged region.

The invention permits numerous embodiments. For further clarification of its basic principle, reference is made in the following to the drawing in which FIG. 1 is a longitudinal section through a front region of a plastic shoe made according to the invention, FIG. 2 is a section through a front region of a mold for manufacturing the plastic shoe.

In the plastic shoe shown partially in FIG. 1, an upper portion 1 is formed integrally with a bottom 2. Disposed in the toe region of the plastic shoe is a steel cap 3. In its upper region the cap delimits the shoe's interior with an inside cushion 4 made of an air-absorbing cushion material. In the lower region the steel cap 3 is set into the plastic foam of the upper portion 1 and of the bottom 2. Inside the bottom 2 the steel cap 3 has a horizontally extending flange 5 which additionally improves the anchoring of the steel cap 3. Inside the plastic shoe there is an orthopedic pad 6 made of cork-latex which can be removed from the shoe.

Figure 2:
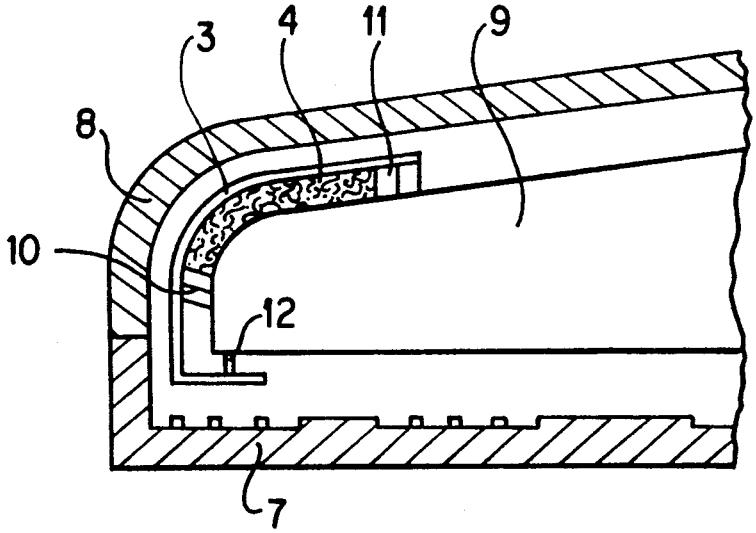

FIG. 2 shows a front region of a horizontally directed lower mold portion 7 which is covered on top by upper mold portion 8. Inside the mold formed by the lower mold portion 7 and upper mold portion 8 is a last 9 as mold core. At its toe the last has upwardly directed spacers 10, 11, each of which is a magnet. On the bottom of the last 9 there are provided other spacers 12 in the form of downwardly directed pins. These spacers 10, 11, 12 position the steel cap 3 on the last 9, so that the cap in its upper region is applied with the cushion 4 against the last 9, but everywhere else is at a small distance from it.

During the manufacture of the plastic shoe, polyurethane is first introduced into the open lower mold portion 7. Then the last, provided with the steel cap 3, is swung into the lower mold portion 7 and then the mold is closed by swinging the upper mold portion 8 onto the lower mold portion 7. The foam-filling plastic surrounds the lower region of the steel cap 3 completely. The displaced air is absorbed by the cushion 4 and partially diverted upward.

What is claimed is:

1. A process for manufacturing a plastic shoe comprising the steps of introducing a foamable plastic into a lower mold, inserting a steel cap having an air absorbing cushion region into the lower mold, closing the mold by placing an upper mold onto the lower mold wherein the steel cap is set into the shoe, and causing said foamable plastic to foam whereby the plastic expands to fill the lower and upper molds.

2. The process of claim 1, wherein the steel cap is inserted into the lower mold portion with a last.

3. The process of claim 2, wherein the steel cap is spaced from the last by inserting spacers between the last and cap.

4. The process of claim 3, wherein the spacers are magnets.

5. The process of claim 1, wherein the steel cap includes a flange which is positioned into the lower mold portion.

6. The process of claim 5, wherein the steel cap is inserted into the lower mold portion with a last.

7. The process of claim 6, wherein the steel cap is spaced from the last by inserting spacers between the last and cap.

8. The process of claim 7, wherein the spacers are attached at the cushion region.

9. The process of claim 7, wherein the spacers are magnets.

* * * * *